US010211565B2

(12) United States Patent
Trimborn

(10) Patent No.: US 10,211,565 B2
(45) Date of Patent: Feb. 19, 2019

(54) PLASTIC SEALING INTERNAL SHEATH FOR A CONDUCTOR CONNECTION, CONNECTION PART, COVER NUT AND SEALED CONNECTION BETWEEN TWO CONDUCTORS

(71) Applicant: Jens Trimborn, Wuppertal (DE)

(72) Inventor: Jens Trimborn, Wuppertal (DE)

( * ) Notice: Subject to any disclaimer, the term of this patent is extended or adjusted under 35 U.S.C. 154(b) by 82 days.

(21) Appl. No.: 15/084,650

(22) Filed: Mar. 30, 2016

(65) Prior Publication Data

US 2016/0294107 A1 Oct. 6, 2016

(30) Foreign Application Priority Data

Mar. 31, 2015 (DE) ..... 20 2015 101 619 U
Jan. 21, 2016 (DE) ..... 20 2016 100 256 U

(51) Int. Cl.
*H01R 13/52* (2006.01)
*H01R 4/34* (2006.01)
*H01R 11/12* (2006.01)
*H01R 11/28* (2006.01)
(Continued)

(52) U.S. Cl.
CPC ..... *H01R 13/5216* (2013.01); *H01R 4/30* (2013.01); *H01R 4/34* (2013.01); *H01R 4/70* (2013.01);
(Continued)

(58) Field of Classification Search
CPC ..... H01R 13/5216; H01R 4/30; H01R 4/34; H01R 4/70; H01R 11/12; H01R 11/284; H01R 13/5219
(Continued)

(56) References Cited

U.S. PATENT DOCUMENTS 3,413,593 A * 11/1968 Schaefer ..... H01M 2/06 439/217
3,605,065 A * 9/1971 Shannon ..... H01M 2/305 429/121

(Continued)

*Primary Examiner* — Tulsidas C Patel
*Assistant Examiner* — Travis Chambers
(74) *Attorney, Agent, or Firm* — Collard & Roe, P.C.

(57) ABSTRACT

The invention initially relates to a plastic sealing internal sheath (13) for a conductor connection between a first conductor (1) and a second conductor (11), wherein, in the connected state, the first conductor (1) is joined with the second conductor (11) by means of a mandrel (12) that yields a conductive connection, wherein the mandrel (12) passes through a push-through area (8) of the first conductor (1). In order to further improve such a sealing internal sheath, it is proposed that the sealing internal sheath (13) that can be slipped over the first conductor (1) exhibits a receiving area (15) for the first conductor (1) completely enveloped transverse to a push-through direction (r) at its end allocated to the push-through area (8) of the first conductor (1), and a passage opening (17) in the push-through direction (r), wherein the passage opening (17) exhibits a first and second opening edge in the push-through direction (r), and has a closed, continuous sealing lip (18) at least on the second opening edge, and the end of the sealing internal sheath (13) facing away from the connection area is designed to interact with the first conductor (1) so as to form a seal. The invention also relates to a connection part for establishing an electrical connection between two electrical conductors. The invention further relates to a casing for sealing an electrical connection between two electrical conductors.

17 Claims, 12 Drawing Sheets

Figure 1:
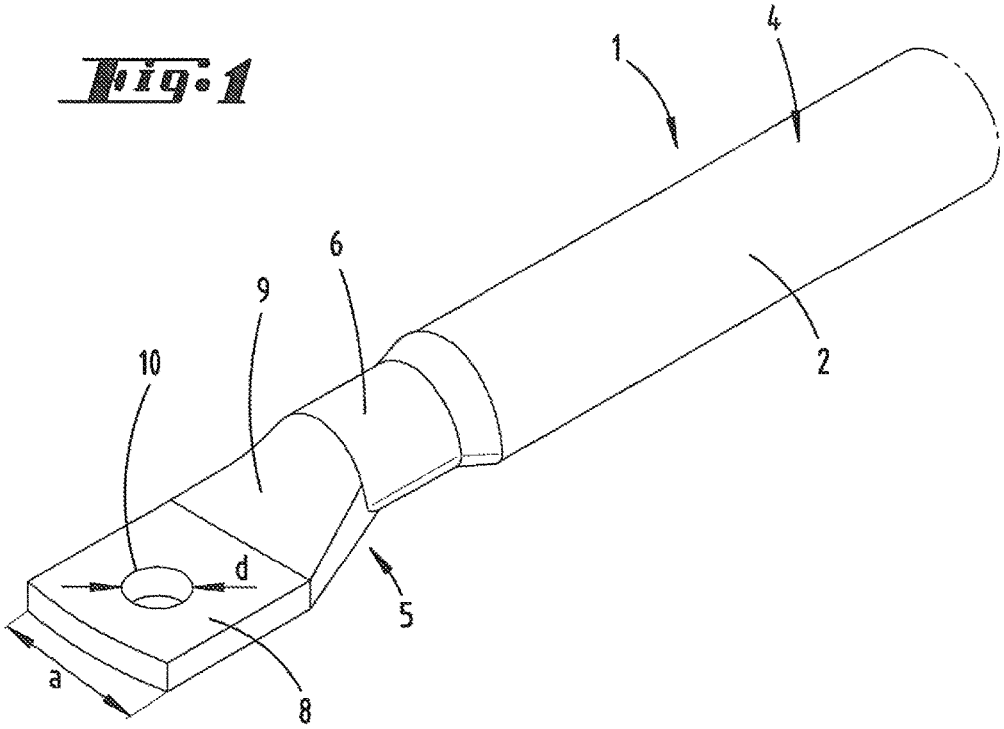

(51) Int. Cl.
*H01R 4/30* (2006.01)
*H01R 4/70* (2006.01)

(52) U.S. Cl.
CPC ..... *H01R 11/12* (2013.01); *H01R 11/284* (2013.01); *H01R 13/5219* (2013.01)

(58) Field of Classification Search
USPC ..... 439/465, 731, 271–282
See application file for complete search history.

(56) References Cited

U.S. PATENT DOCUMENTS 3,775,730 A * 11/1973 Rowls ..... H01M 2/305 429/65
3,992,075 A * 11/1976 Cannarsa ..... H01R 11/289 439/755
4,118,097 A * 10/1978 Budnick ..... H01M 2/206 439/387
4,572,878 A * 2/1986 Daugherty ..... G01K 1/14 374/E1.018
5,013,259 A * 5/1991 Maurer ..... H01R 11/288 439/504
5,346,408 A * 9/1994 Chupak ..... H01R 11/284 174/138 F
5,620,338 A * 4/1997 Stephens ..... H01R 11/281 439/522
5,833,499 A * 11/1998 Gonzales ..... H01M 2/34 439/522
2017/0117640 A1 * 4/2017 Arenburg ..... H01R 4/70

* cited by examiner

XVII
XVII
1
2
5
11
23
24
25
26
27
29
30
31
32
33
34
35
37
38
39
40
41
43
A
r

PLASTIC SEALING INTERNAL SHEATH FOR A CONDUCTOR CONNECTION, CONNECTION PART, COVER NUT AND SEALED CONNECTION BETWEEN TWO CONDUCTORS

CROSS REFERENCE TO RELATED APPLICATIONS

Applicant claims priority under 35 U.S.C. § 119 of German Application No. 20 2015 101 619.0 filed on Mar. 31, 2015 and German Application No. 20 2016 100 256.7 filed on Jan. 21, 2016, the disclosures of which are incorporated by reference.

The invention first relates to a plastic sealing internal sheath for a conductor connection between a first conductor and a second conductor, wherein, in the connected state, the first conductor is joined with the second conductor by means of a mandrel that yields a conductive connection, wherein the mandrel passes through a push-through area of the first conductor.

Plastic sealing internal sheaths of the kind in question are known in the art. The latter are used in particular as a moisture-proof cover for an electrical connection, for example in motor vehicles. Known in this conjunction is such a plastic sealing internal sheath for a connection between a first conductor and a starter battery of a motor vehicle.

When in use, the plastic sealing internal sheath covers the connection area, and is intended in particular to prevent moisture from being able to penetrate into the conductor insulated at the end for purposes of the electrical connection.

With respect to the known prior art, one technical problem facing the invention is regarded as further improving a plastic sealing internal sheath of the kind in question.

One possible solution to the object is provided by a first inventive idea for a plastic sealing internal sheath, in which the aim is for the sealing internal sheath that can be slipped over the first conductor to exhibit a receiving area for the first conductor completely enveloped transverse to a push-through direction at its end allocated to the push-through area of the first conductor, and a passage opening in the push-through direction, wherein the passage opening exhibits a first and second opening edge in the push-through direction, and has a closed, continuous sealing lip at least on the second opening edge, and for the end of the sealing internal sheath facing away from the connection area to be designed to interact with the first conductor so as to form a seal.

The end of the first conductor, which is usually insulated for purposes of the electrical connection, can be completely enveloped by the proposed sealing internal sheath, except for an area exhibiting the passage opening for establishing the electrical connection. The receiving area on the sleeve side can here envelop the area of the first conductor exhibiting the passage opening of the first conductor, and possibly so as to completely enclose the latter, as is also preferred. Acting in conjunction with the continuous sealing lip, which envelops the passage opening, in particular the second opening edge, a reliable insulation can be achieved to prevent moisture from penetrating into the electrical conductor from outside. The sealing lip preferably exerts its effect only during the usual process of fixing the first conductor to the second conductor by means of the mandrel.

A separate seal can be provided in the area of the additional (first) opening edge of the passage opening. This opening edge can be overlapped by a lid, for example. Such a lid, e.g., a hinged lid, can preferably be brought to the sealing internal sheath in a position that seals the conductor connection.

The area of the additional, in particular first opening edge can also be separately sealed in a different manner, e.g., by spraying an electrically insulating compound onto the opening, for example a fat or adhesive, in particular a hot-melt adhesive or 2-component adhesive.

In any event, an area encapsulated on both sides can be present, as is also preferred.

In another possible embodiment, this can be achieved by forming two continuously closed sealing lips allocated to a respective opening edge.

The sealing internal sheath can be designed in such a way that, once the electrical connection has been established between the first and second conductors, it can be assembled and correspondingly preferably also disassembled without destroying the latter.

Another sealing area is provided in the end area of the sealing internal sheath facing away from the connection area, and also interacts with the first conductor. This sealing interaction is preferably independent of an electrical connection between the first conductor and second conductor, for example established by a screw connection.

The sealing internal sheath is preferably made out of an elastic, resilient material, e.g., in particular a thermoplastic material or also rubber, and further silicone rubber, for example. The sealing internal sheath or the material used for the latter can further preferably exhibit a modulus of elasticity that is less than 5 $kN/mm^2$, further preferably less than 3.3 $kN/mm^2$.

In order to interact with the first conductor at the end facing away from the connection area so as to establish a seal, the latter can exhibit a tapering section. Proceeding from a connection area or starting a distance away from the latter, this section can have a conically tapering design, with a smallest diameter at the end side that is equal to or less than the diameter of the first conductor in the contact surface of the tapering section.

This end of the sealing internal sheath can also be enveloped by a shrinking tube, for example, which simultaneously extends over the allocated section of the first conductor, and thereby provides a seal between the first conductor and sealing internal sheath.

In addition, the seal in this area can also be achieved via a cable gland with PG thread (so-called PG threaded screw connection), or alternatively via a clamp ring in the form of a hose clamp, which is pulled over the end area of the sealing internal sheath. In this regard, it is further possible to insert a sealing ring, for example an O-ring, or a stuffing box on the end side between the sealing internal sheath and first conductor.

The upper and/or lower sealing lip can also be overtopped by a contour of the area adjoining the sealing lips in a front view, at least in its central area, in a longitudinal direction of the sealing internal sheath or the first conductor with the sealing internal sheath applied. The design of this adjoining area can be adjusted to the configuration provided in the corresponding area of the first conductor.

The receiving area with the sealing lips can extend in offset planes relative to a parallel running plane that essentially centrally passes through the first conductor.

The area overtopping the sealing lip can here exhibit a height going beyond the sealing lip as viewed in the push-through direction, which corresponds to a multiple, for example of 5 to 50, further for example of 10 to 30, times the free sealing lip height. The free sealing lip height is here preferably measured from a plane in which the sealing lip continuously transitions into the receiving area up until the free end of the sealing lip relative to a vertical section through the sealing lip, e.g., up until the zenith of the latter.

In the unattached state of the sealing internal sheath, the latter can exhibit an opening in the area of the tapering section, wherein this opening exhibits a given diameter dimension that is smaller in each direction than a largest dimension of the first conductor in the push-through section. The largest dimension of the first conductor in the push-through section can correspond to a multiple, in particular 1.2 to 2 times, for example 1.5 times, the opening diameter dimension in the tapering section of the sealing internal sheath.

The sealing internal sheath is preferably attached to the end of the first conductor to be sealed in such a way that the push-through section of the first conductor is initially guided through the opening in the area of the potentially provided tapering section of the sealing internal sheath. Due to the elastically resilient configuration of the entire sealing internal sheath, any tapering section provided can expand while placing the sealing internal sheath onto the first conductor as the push-through section penetrates through the tapering section, so that it can subsequently interact with the corresponding section of the first conductor so as to form a seal owing to the resetting. The edge enveloping the opening comes to automatically abut against the allocated area of the first conductor.

The sealing internal sheath can exhibit a length corresponding to two or several times, preferably up to 10 times, the free diameter of a push-through opening of the first conductor. With the sealing internal sheath attached, the push-through opening of the first conductor is enveloped by the receiving area and exposed for electrical connection in the area of the sleeve-side passage opening. The mandrel can be used to establish the electrical connection with the second conductor via the push-through opening.

The sleeve-side passage opening can exhibit a diameter measure corresponding to a multiple of the diameter measure of the conductor-side push-through opening. The measure of the sleeve-side passage opening can correspond to 2 to 5 times the diameter measure of the conductor-side passage opening, for example.

Allocated to the receiving area, the sealing internal sheath can in any event exhibit the outer contour of a cable lug. The end side of the electrical conductor is preferably provided with a cable lug, in particular with a cable lug made out of a pipe section. This cable lug establishes an electrical connection with the electrically conductive, insulation-encased wires of the first conductor. For example, the connection between the cable lug and wires of the electrical conductor is established by compression or crimping.

In a preferred configuration, the sealing internal sheath assumes the overall outer contour of the cable lug of the first conductor.

The sealing internal sheath is preferably configured in such a way that its sleeve interior abuts at least largely on the allocated surface of the cable lug and/or insulating sleeve of the electrical conductor. In the connected state, the sealing internal sheath can also envelop the first conductor partially at a distance transverse to its longitudinal extension, e.g., in the area of the cable compression or crimping. A radial distance measure between the sealing internal sheath and cable lug ranging from 1 to 10 mm can arise in relation to a longitudinal axis of the first conductor.

The first conductor exhibits an insulating jacket. In the connected state, the tapering section of the sealing internal sheath or the lip-like edge enveloping the relevant opening interact with an outer surface of the jacket so as to form a seal. By shortening the tapering section, the diameter of the resultant opening in the area of the tapering section can be adjusted to the outer diameter of the jacket, so that a sufficient seal can be achieved in the area of the jacket in the connected state, even given varying cross sectional dimensions for the conductor. This can be achieved by a preferred conical configuration of the tapering section.

The sealing lip can exhibit a free height of 0.5 to 3 mm, and a thickness transverse to the push-through direction of 0.5 to 3 mm.

The sealing lip can also transition radially inwardly directly into the passage opening of the receiving area on the sealing internal sheath side.

In another configuration, the sealing can transition into a flat region in a cross section. This flat area extends outside of the sealing internal sheath wall, correspondingly facing away from the first conductor or cable lug, and proceeding from the sealing lip, at least directed radially outwardly and/or in the longitudinal direction of the sealing internal sheath.

The flat area can extend beyond the sealing lip by at least the measure of the thickness of the sealing lip, as much as by 10 times or more, as much as by 50 times the thickness of the sealing lip without any elevations or depressions.

The invention further relates to a connection part for establishing an electrical connection between two electrical conductors, with a metallic electrical conductor element that is enveloped at least in one connection area with an elastically resilient plastic, and a sealing lip that envelops the connection area, wherein the connection area exhibits an opening that can be penetrated in the push-through direction by a connection means, such as a screw or bolt.

Connection parts of the kind in question are known. The latter are used for establishing an electrical connection between two electrical conductors, wherein the connection part is situated on one of the electrical conductors. The conductor element provided in the connection part and sheathed with plastic is connected in an electrically conductive manner with a connection section of a first conductor.

The plastic sheathing is used for electrically insulating the connection area. An elastically resilient sealing lip can be used in particular for fabricating an electrical connection that is outwardly sealed against penetration by moisture.

As concerns known prior art, the invention views one technical problem as further developing a connection part of the kind in question in an advantageous manner.

According to a first inventive idea, one potential solution to this task involves a connection part in which the goal is to have the conductor element, in a cross section in which the push-through direction appears as a line, exhibit a first area on a first height level and a second area on a second height level, wherein the first area is farther away from the opening than the second area (viewed in the direction of longitudinal extension of the conductor element and/or the connected conductor), the first area comes before the second area in the push-through direction, and the sealing lip is designed to envelop the second area, wherein another connecting section formed on one or more height levels can adjoin the area on the higher height level further away from the opening, and be able to force back the sealing lip in the push-through direction over the second area of the conductor element otherwise exposed on the sealing lip side in the non-deformed state, but through deformation until into a plane that forms the lower side of the second area.

The first area of the conductor element is used in particular for establishing an electrical connection with the allocated conductor. This connection area between the first area of the conductor element and conductor or its connection area is preferably also encased by the plastic of the connection part.

The second area of the conductor element runs offset to the first area as viewed in the push-through direction, and further preferably is used to establish an electrical connection with the additional conductor, and beyond that to correspondingly establish a mechanical connection with the additional conductor, e.g., by way of a screwed connection.

The offset viewed in the push-through direction from the second area to the first area of the conductor element preferably corresponds to at least the material thickness of the conductor element, preferably to a multiple of the conductor element thickness, up to a multiple of 10.

The plastic sheathing can be obtained by insert molding the conductor element and connection section of the allocated electrical conductor with plastic, in particular elastically resilient plastic. The sheathing can also be present as a separately fabricated component, which can be assembled in the connection area, if necessary even after establishing the electrical connection. Such a sheathing can also be preferably non-destructively disassembled.

The continuous sealing lip is used to form an outward seal against penetrating moisture in the connected setting from outside. A section of a screw or bolt, e.g., the flat side of a screwed nut or screw head, acts against the sealing lip in the connected setting, and further potentially also against the flat side of a washer.

It can also be provided that the connection part exhibit two continuous sealing lips in a cross sectional view, which are situated opposite to each other relative to the push-through direction. In such an embodiment, a continuous sealing lip is provided on either side of the push-through opening as viewed in the push-through direction.

Apart from that, a sealing lip can lie opposite the area of the plastic sheathing enveloping the sealing lips due to a material superelevation in the push-through direction. A continuous sealing lip can thus have a bulging shape, and can be elastically deformed through exposure to a screw head or screwed nut.

The transition between the first and second height level of the conductor element can have a stepped cross section. A resultant lowering can thus be designed to be rotationally symmetrical to an axis passing through the push-through opening of the conductor element in the second area. The lowering can be shaped like a pot overall, with in particular an exposed pot floor for purposes of electrical connection and a pot wall preferably running perpendicular to the pot floor plane. The conductor element is preferably exposed in the area of the pot floor on either side for purposes of electrical contacting. In a further development, the inner wall of the pot can also be exposed, i.e., not covered by plastic.

The enveloping plastic can continue in an exposed collar opposite the lowering provided by the conductor element on the second height level. The collar can here be ring-shaped overall, with a preferred inner diameter that can correspond to the free inner diameter of the pot-shaped lowering.

The collar can exhibit a latching lip that is continuous or also partially continuous in a circumferential direction. In a preferred embodiment, the latter faces radially outward.

The latching lip can be used for establishing a latched connection with a cap. A screw head or the like nestled in the lowering can thereby be covered by the cap so as to form a seal. The elastically resilient configuration of the plastic allows the user to fixedly latch the cap to the collar, as well as to remove the cap from the collar, preferably without any tools.

The cap can be present as a loose part. In a preferred embodiment, the cap is formed as a single piece with the plastic sheathing by way of a bendable extension. The bendable extension can take the form of a strip material, which enables placement on or removal from the collar while retaining the connection between the cap and plastic sheathing.

In another embodiment, the conductor element can be part of a cable lug.

One possible embodiment provides that the sealing lip be part of a foldable or pluggable casing that can be placed on the conductor element. Preferably after the electrical plug connector has been fabricated, the casing can be secured so as to envelop the connection area. The casing exhibits one or more sealing lips so as to form a seal against at least one of the conductors, if necessary against both conductors.

The casing can be a plastic casing, in particular a hard plastic casing, and can have a hinge system giving it a foldable design. For example, the hinge system can be a film hinge joint. When folded open, the casing is placed around the connection location, and then moved into a closed position, in which the one or several seals tightly abut against one or both electrical conductors. The closed casing position is preferably secured, for example with a latch.

A pluggable casing can also be provided, e.g., consisting of two casing parts that are initially separated from each other, for example casing halves. The latter can be plugged together to encase the electrical plug connector. This closed casing position is also preferably secured.

The secured casing closure can be reversible.

Additionally or alternatively to the sealing lip(s) that act(s) axially in the push-through direction, several, in particular two, radially acting sealing lips can also be provided.

The invention further relates to a casing for sealing an electrical connection between two electrical conductors.

In order to further improve a casing of the kind in question, it is proposed that the casing be designed as a foldable or pluggable casing, and exhibit a molded-on or inlaid sealing lip, such that the sealing lip protrudes over an area of the casing without a sealing lip with the casing placed on a conductor.

In the push-through direction of the conductor or electrical connection area, the sealing lip acts by way of the casing in an axial direction and/or radial direction against one or both conductors of the electrical connection. The abutment by the sealing lip against the electrical conductor is secured in the closed state of the casing.

In this regard, a foldable casing can be involved, for example consisting of two housing halves, which are joined together by a hinge, further for example by a hinged joint. The casing parts, for example casing halves, can also be present as single parts used to form a pluggable casing.

The closed folded or plugged position of the casing is preferably secured, for example by latching.

If the casing is configured as a foldable casing, the latter is preferably designed as a single part, if necessary except for the sealing lip, which can be allocated to the foldable casing as a loose part.

The casing preferably consists of a hard plastic, further preferably fabricated in a plastic injection molding process, while the sealing lip consists of a soft plastic or rubber material. Given a single-piece configuration for the casing and sealing lip, the casing can be manufactured in a two-component injection molding process, for example.

In addition, the invention relates to a cover nut for an electrical conductor connection, wherein the cover nut is closed in cross section opposite a screw-in opening, and forms a lower contact surface that runs perpendicular to a placement direction.

Cover nuts of the kind in question are known. The latter are used in particular while establishing an electrical connection between two electrical conductors, further in particular in conjunction with a screw or a bolt.

With regard to known prior art, a technical problem of the invention is regarded as further developing and improving a cover nut of the kind in question so that the latter becomes outwardly electrically insulated in design.

The object is initially and essentially achieved by completely enveloping the cover nut with plastic, but up to a plane of the contact surface relative to a cross section in the area of the screw-in opening. The cover nut is outwardly electrically insulated by the enveloping plastic in the use position. Preferably all surfaces of the cover nut that face outwardly in the use position are covered by the plastic.

In the area of the screw-in opening for the bolt or screw, the surface of the cover nut enveloping the screw-in opening can be exposed and electrically conductive, and accordingly not be covered by the plastic.

The plastic can be applied by insert molding the otherwise metal cover nut. Further preferred in this regard is a positive connection between the plastic and cover nut, so that the plastic cover is fixed against displacement in the direction of a cover nut axis, and also joined with the cover nut so as not to rotate in the circumferential direction.

The plastic can be a hard plastic, correspondingly preferably not elastically resilient in design.

The plastic enveloping the cover nut can also form wrench surfaces, in particular for actuating the cover nut, e.g., by means of a wrench. In conventional threaded nuts, six wrench surfaces are formed over the circumference, wherein opposing wrench surfaces running parallel to each other exhibit a distance corresponding to a conventional wrench width.

In addition, the cover nut can exhibit a sealing bead that protrudes over the contact surface in the insertion direction in a cross section relative to the contact surface. In a connection position, the sealing bead preferably serves to form a seal against a facing surface of one of the conductors to be connected.

The sealing bead can consist of rubber or an elastically resilient plastic (elastomer plastic). In addition, the sealing bead can initially be present as a separate component, e.g., in the form of an annular seal, which is placed in a correspondingly designed annular groove in the area of the contact surface prior to using the cover nut.

In a preferred configuration, the sealing bead is partially covered in cross section by the plastic that otherwise envelops the cover nut. The enveloping plastic can exhibit a corresponding groove for accommodating the sealing bead. In addition, an elastic resilient sealing bead can be insert molded with the hard plastic, or further, for example during a two-component injection molding process, be fabricated simultaneously with the plastic enveloping the cover nut.

The invention also relates to a sealed connection between two electrical conductors, wherein the one electrical conductor exhibits a connection part with a metal electrical conductor element, which is enveloped at least on one terminal area by an elastically resilient plastic, wherein the terminal area exhibits an opening that is penetrated by a connection means, such as a screw or bolt, in a push-through direction, wherein a plastic-sheathed cover nut is further screwed onto the bolt, or the screw exhibits a plastic-sheathed screw head.

Sealed connections of the kind in question are known.

In order to have such a connection be outwardly electrically insulated and protected against moisture penetrating from outside, a first inventive idea provides that the plastic sheathing of the cover nut or screw head be sealed away from the conductor element by a sealing lip consisting of plastic or rubber, and that the side of the connection part of the electrical conductor element facing away from the cover nut or screw head exhibit a sealing lip that interacts with the second conductor.

In a corresponding connection in which the second conductor is further penetrated by the screw or bolt, wherein the screw or bolt is provided on the side of the second conductor lying opposite the conductor element with a cover nut for mounting the second conductor to the conductor element, it is provided that the cover nut be enveloped by plastic, and exhibit a sealing bead made out of plastic or rubber, which seals the cover nut away from the second conductor, and that the side of the connection part of the electrical conductor element facing away from the facing cover nut or the facing screw head exhibit a sealing lip that interacts with the conductor element.

With regard to the configuration of the plastic-sheathed connection part or the cover and/or connecting nut, reference is made to the explanations pertaining thereto in the specification.

An electrically insulated connection protected against moisture penetrating from outside is created. In particular the electrically conductive conductor element of the connection part is sealed on both sides as viewed in the push-through direction.

The features in the independent claims described above are essential both taken in isolation and in any combination with each other, wherein features in an independent claim are further combined with the features of another independent claim or with features of several independent claims, but also with only individual features of one or more of the other independent claims.

In terms of disclosure, the ranges or value ranges or multiple ranges indicated above and below also encompass all intermediate values, in particular in 1/10 increments of the respective dimension, potentially dimensionless as well. For example, the indication 0.5 to 3 mm also includes the disclosure 0.6 to 3 mm, 0.5 to 2.9 mm, 0.6 to 2.9 mm, 0.9 to 1.8 mm, etc., and the disclosure 2 or multiple also includes 2.1 or multiple, 2.2 or multiple, etc. This disclosure can serve on the one hand to limit a specified range limit from below and/or above, but alternatively or additionally to also disclose one or more singular values from a respectively indicated range.

Figure 2:
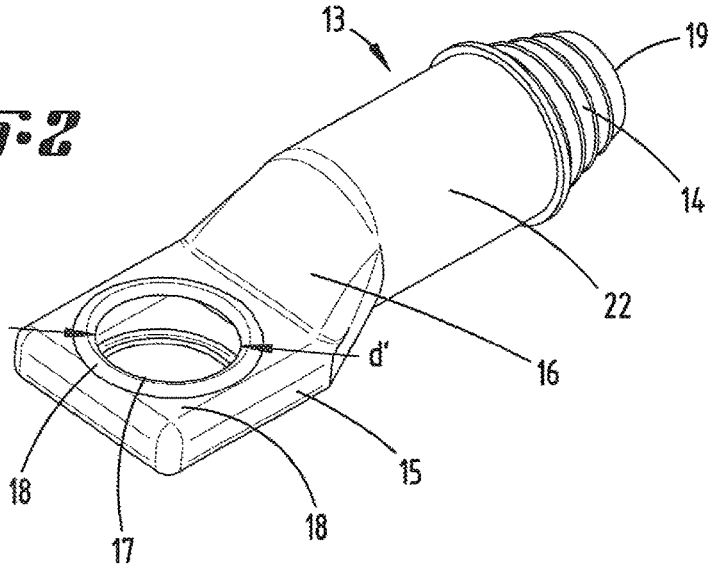
Figure 3:
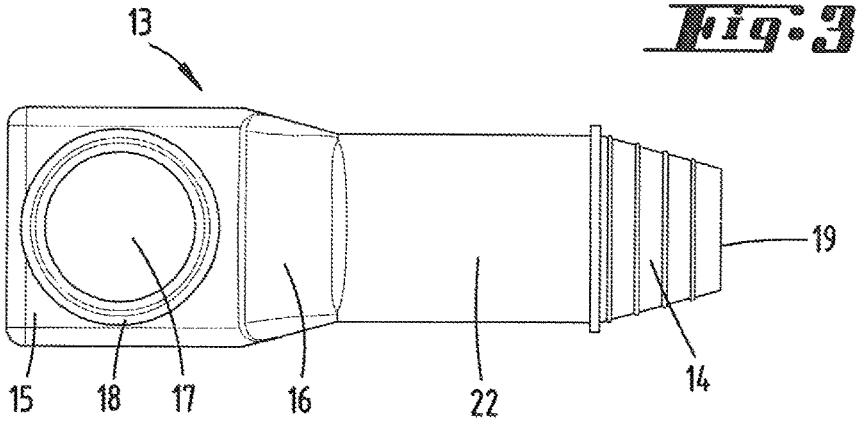
Figure 4:
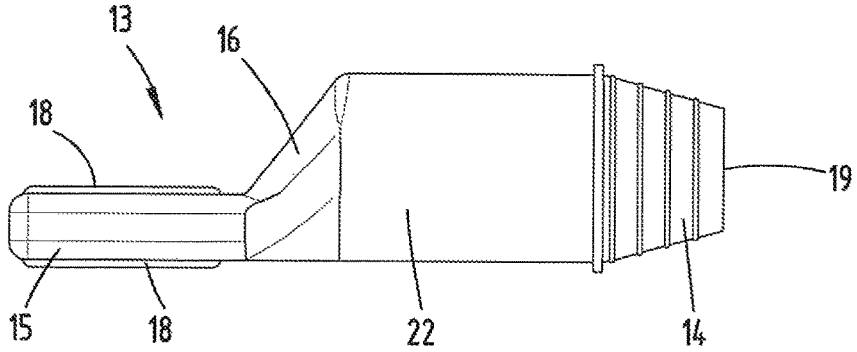
Figure 5:
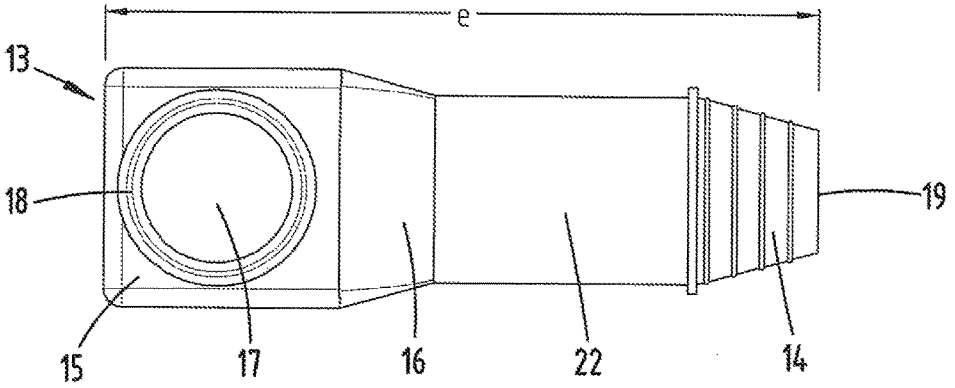
Figure 6:
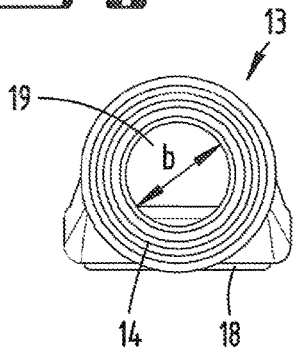
Figure 7:
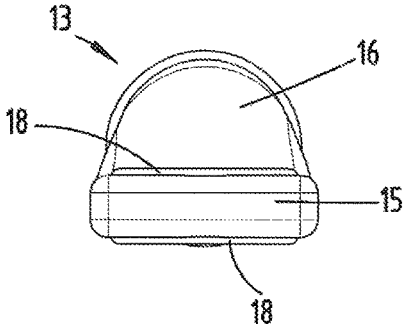
Figure 8:
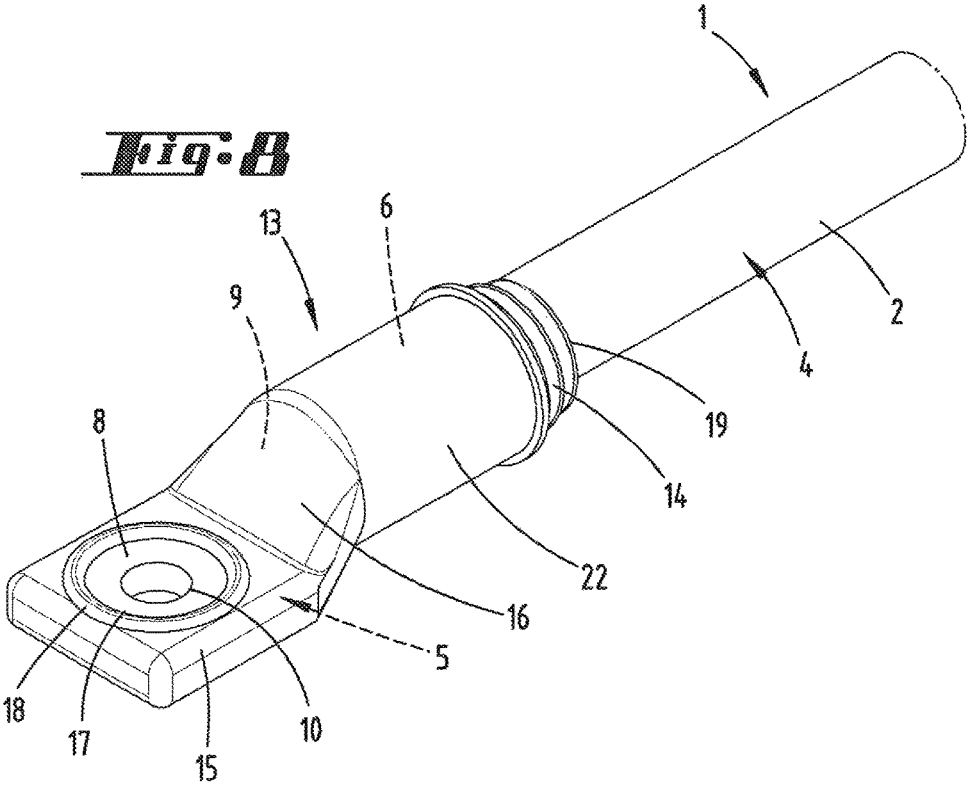
Figure 9:
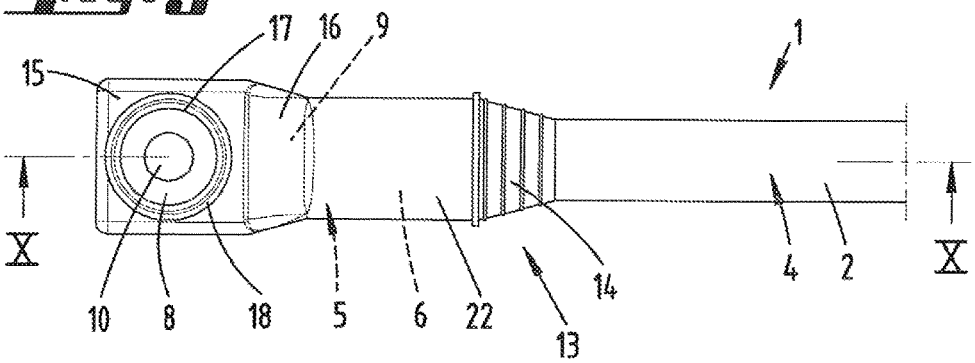
Figure 10:
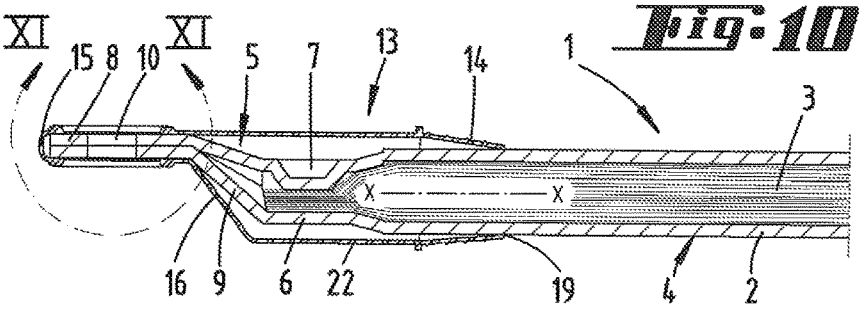
Figure 11:
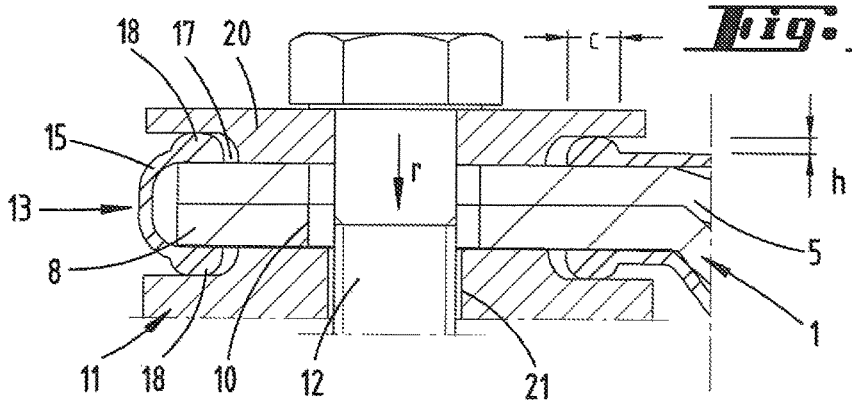
Figure 12:
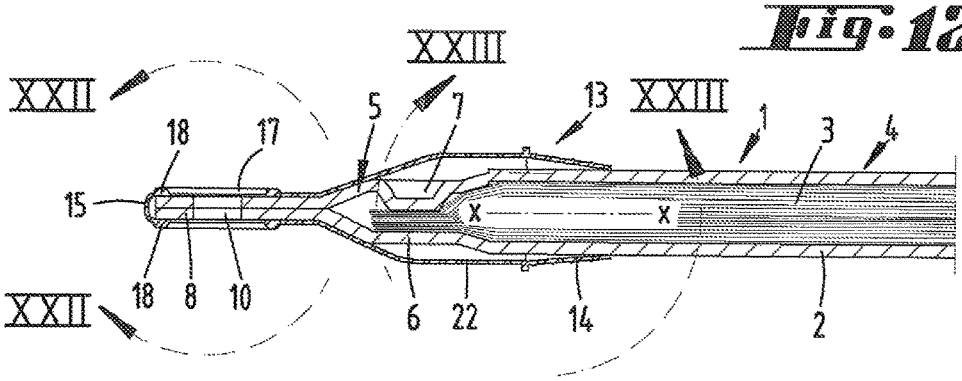
Figure 14:
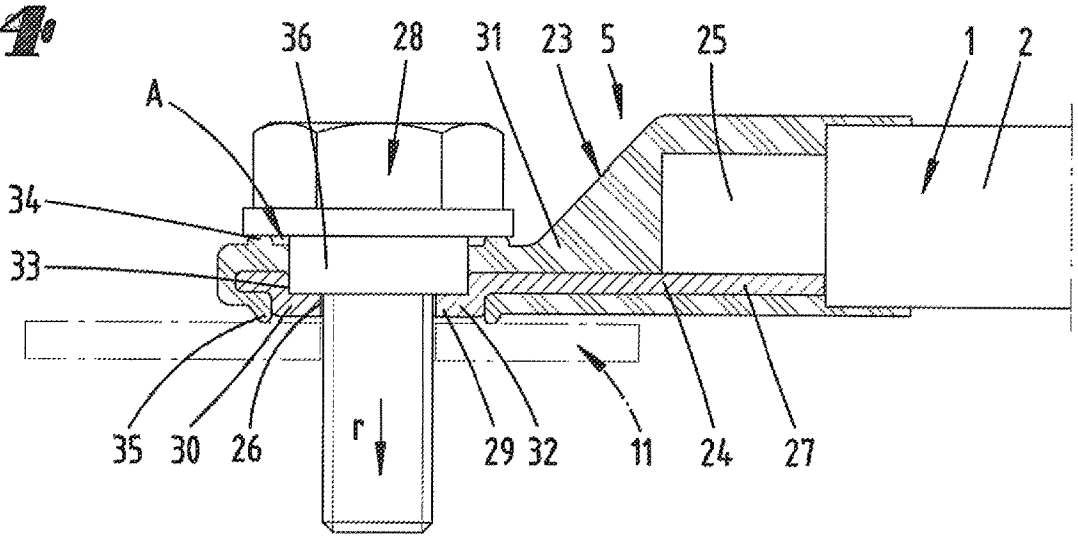
Figure 13:
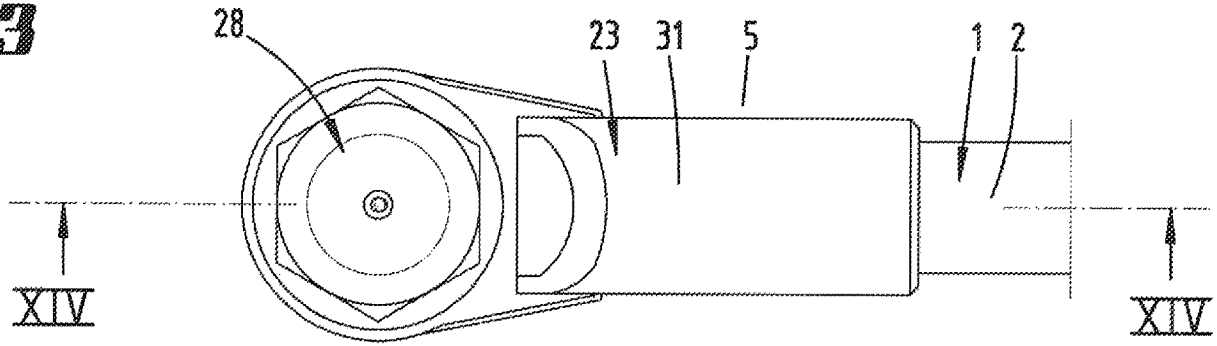
Figure 15:
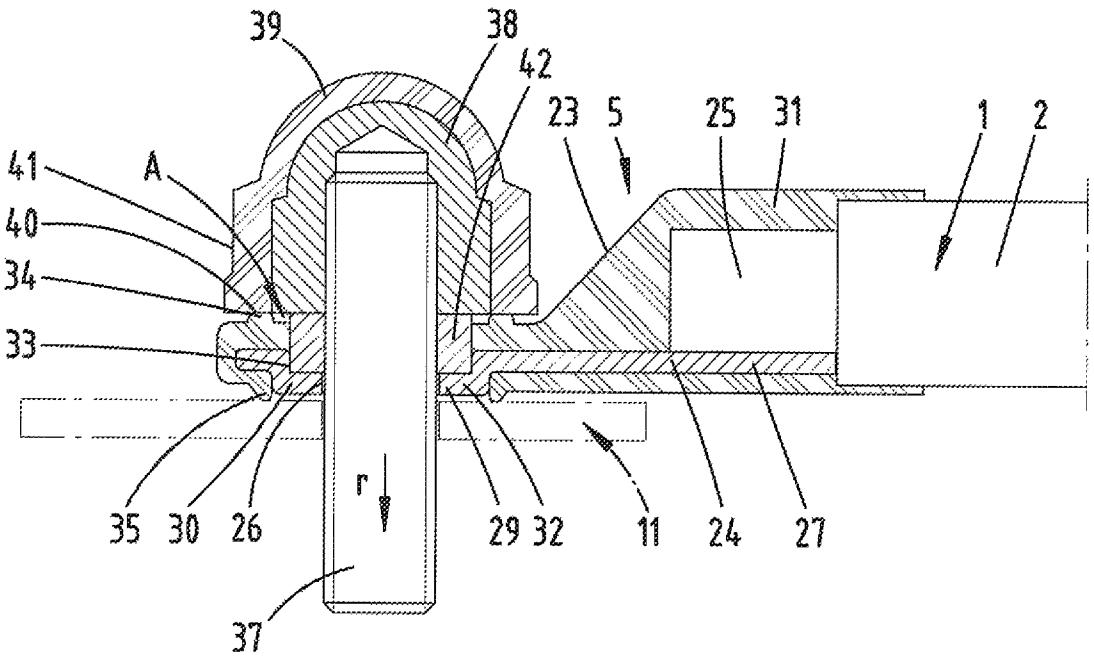
Figures 1B, 1F, 1G:
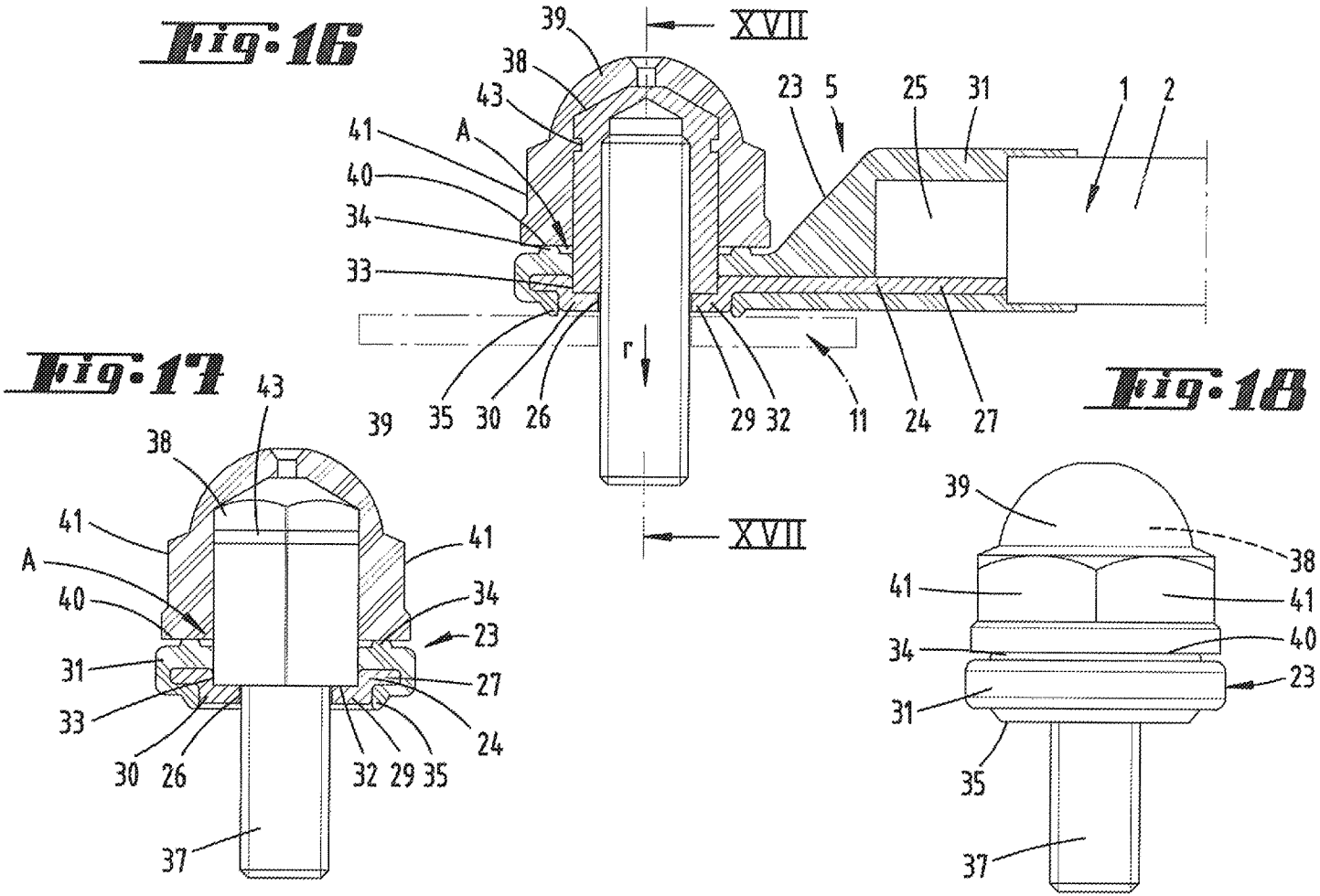
Figure 20:
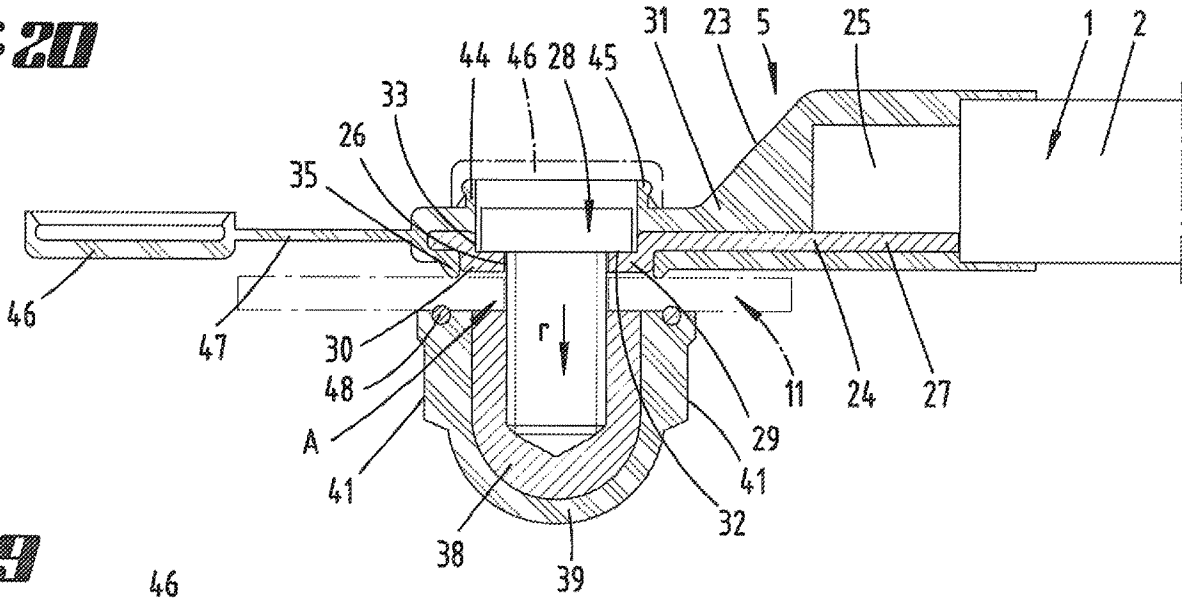
Figure 19:
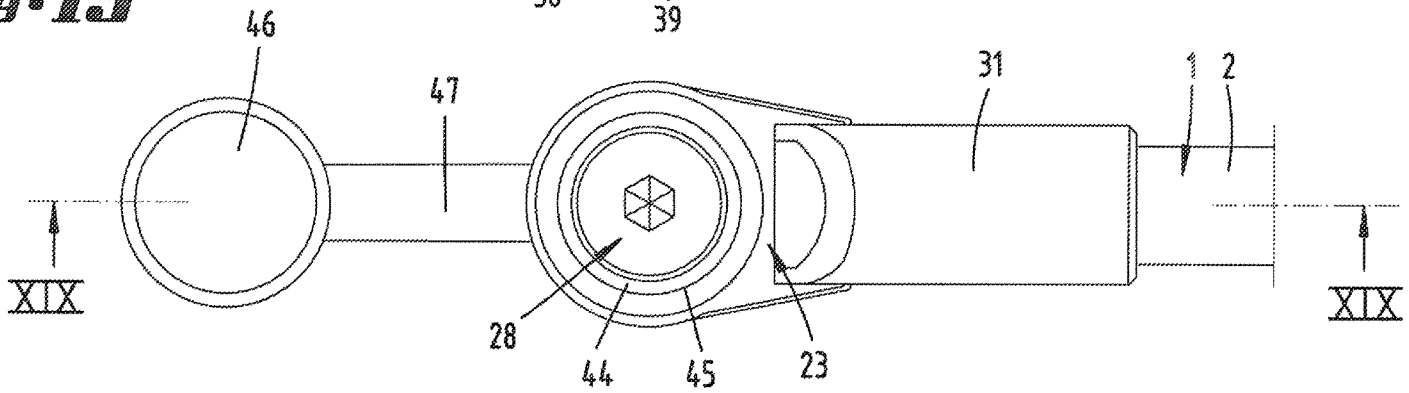
Figure 21:
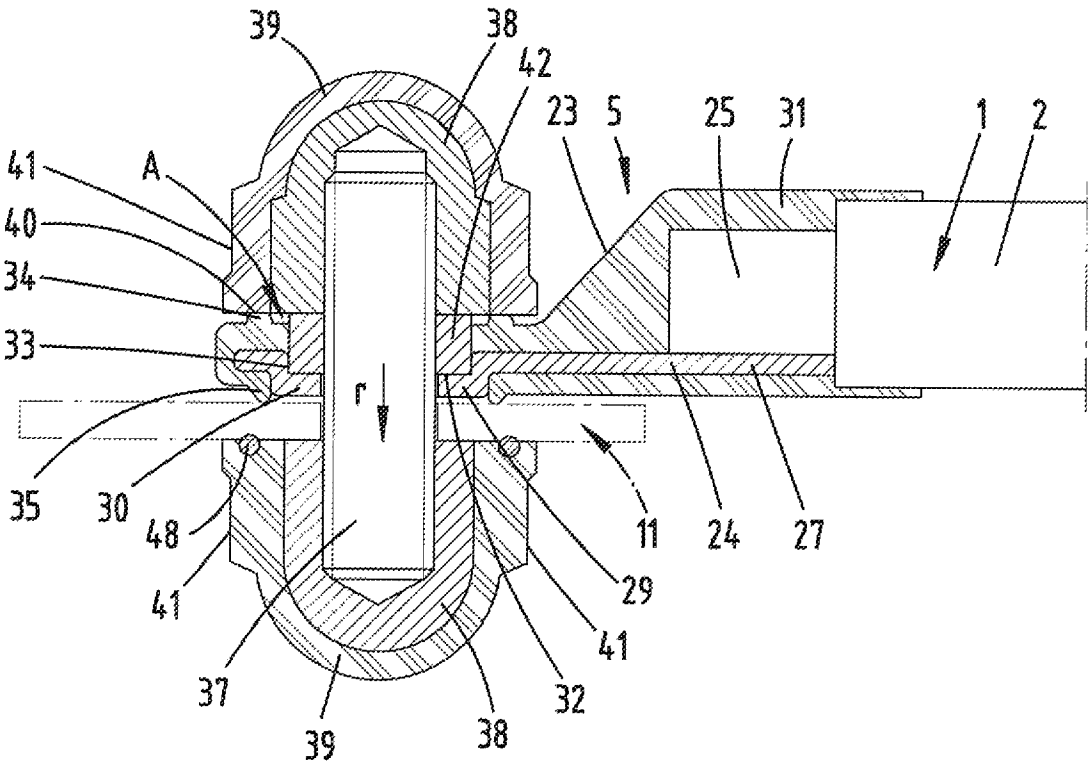
Figure 22:
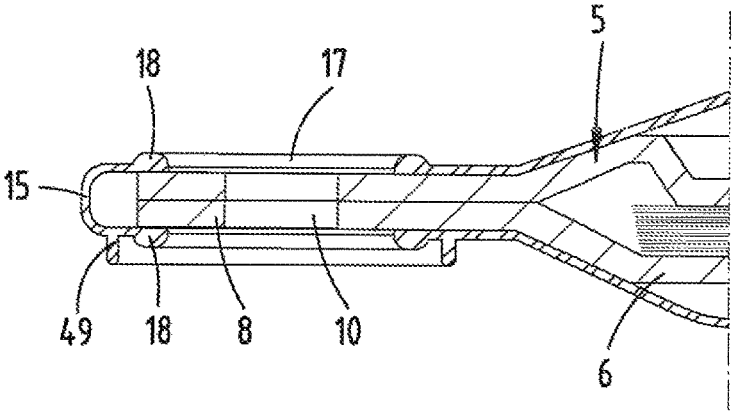
Figure 23:
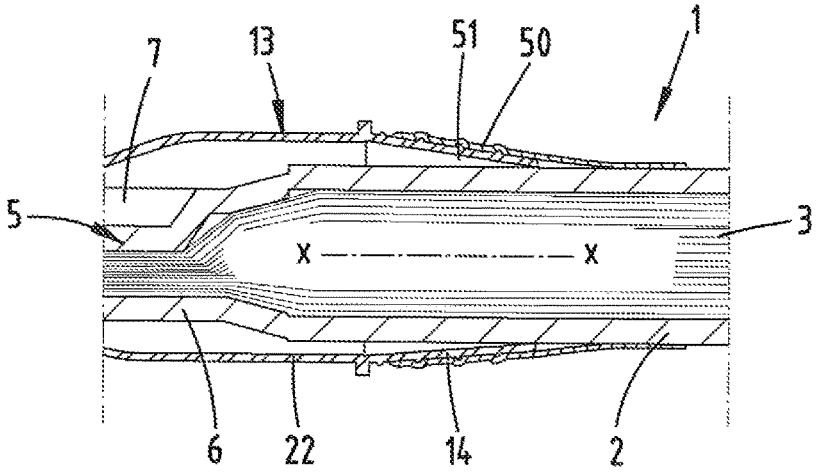
Figure 23A:
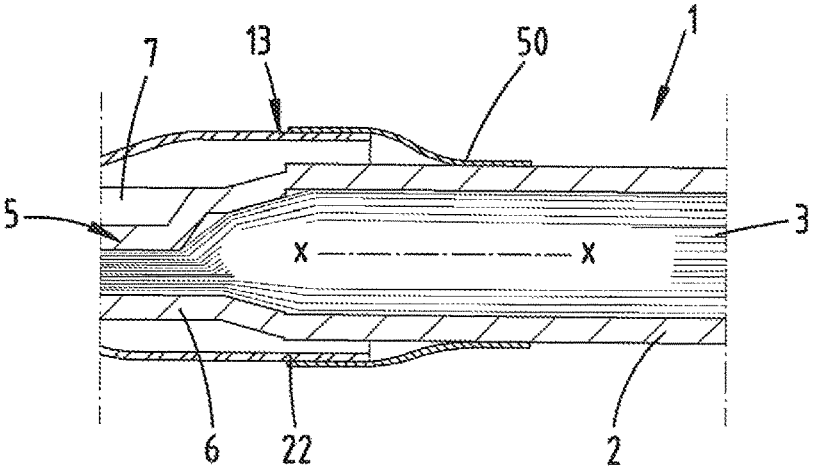
Figure 24:
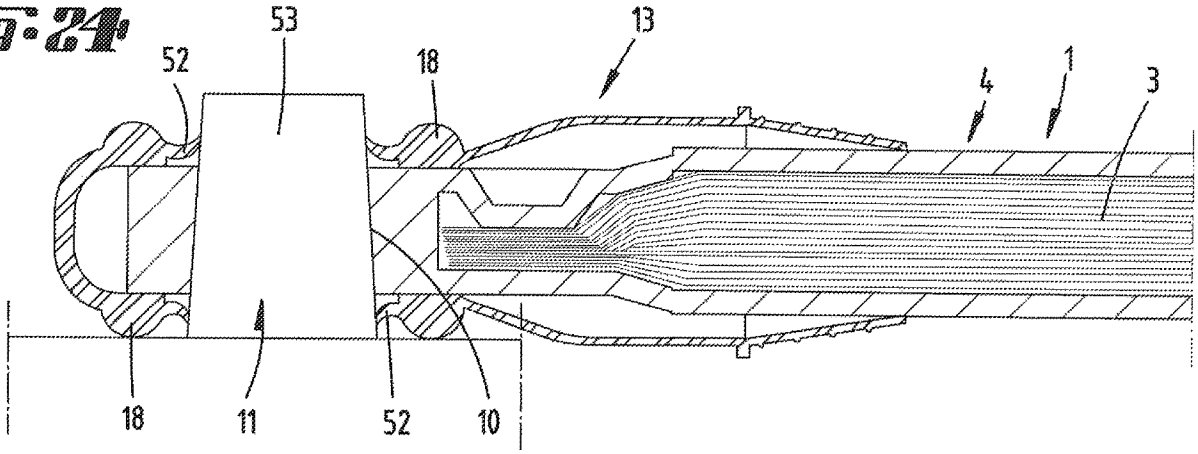
Figure 25:
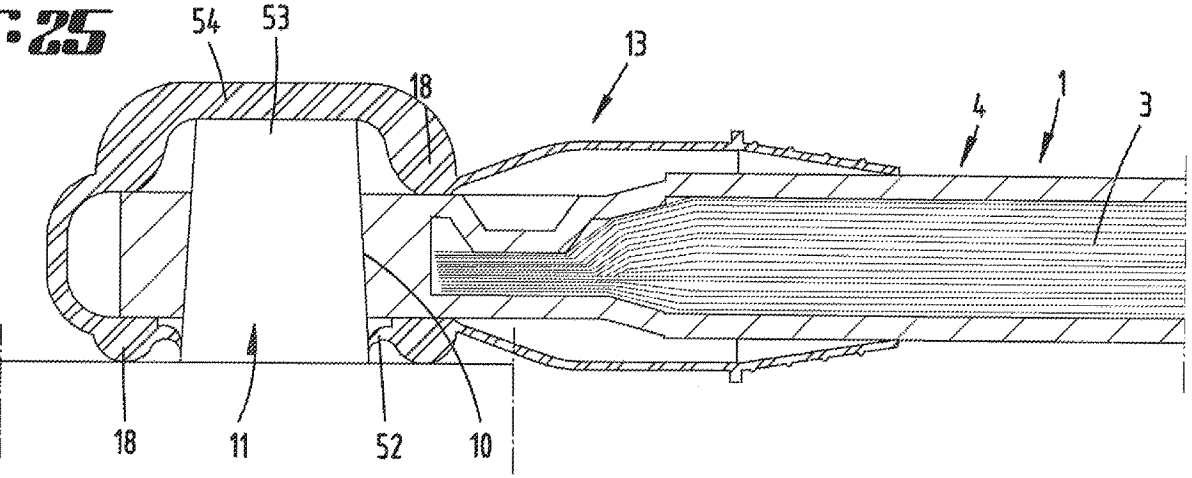
Figure 26:
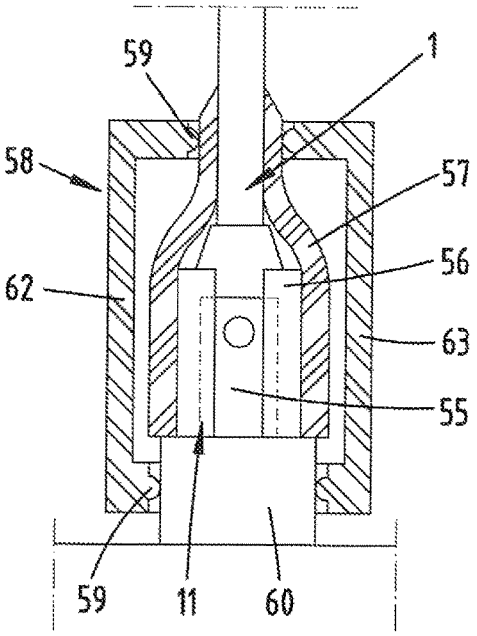
Figure 27:
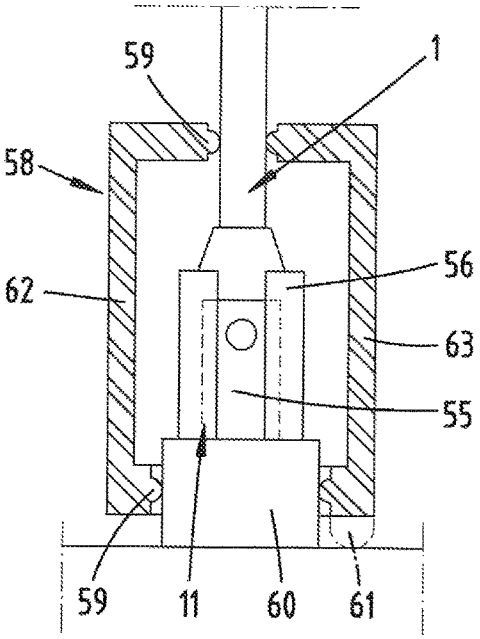
Figure 28:
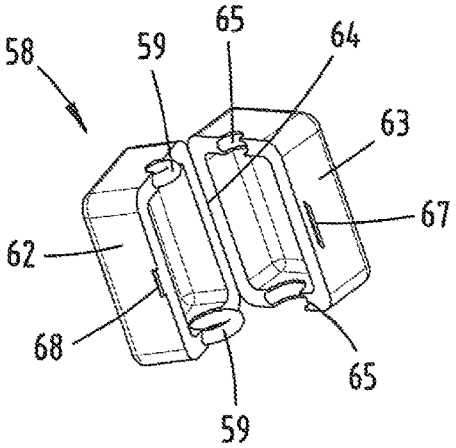
Figure 29:
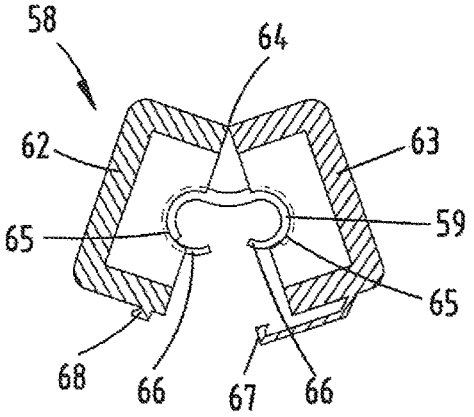

The invention is described based on the attached drawing below, but the latter only depicts exemplary embodiments. A part that is described only in relation to one of the exemplary embodiments and is not replaced in another exemplary embodiment based on the highlighted feature therein is hence also described as an at least potentially present part for this additional exemplary embodiment. The drawing shows:

FIG. 1 a perspective view of a first conductor;

FIG. 2 a perspective view of a plastic sealing internal sheath to be arranged on a first conductor;

FIG. 3 a top view of the sealing internal sheath;

FIG. 4 a side view of the latter;

FIG. 5 a bottom view against the sealing internal sheath;

FIG. 6 the sealing internal sheath from behind, with a view of a connection area;

FIG. 7 a front view of the sealing internal sheath;

FIG. 8 a perspective view of the connected state of the sealing internal sheath and first conductor;

FIG. 9 a top view of the latter;

FIG. 10 the section according to line X-X on FIG. 9;

FIG. 11 a magnification of area XI on FIG. 10, relating to the electrically connected state between the first conductor and a second conductor;

FIG. 12 the section according to FIG. 10, relating to a second embodiment;

FIG. 13 a top view of a connection part in one embodiment;

FIG. 14 the section according to line XIV-XIV on FIG. 13;

FIG. 15 a sectional view according to FIG. 14, relating to an embodiment with a cover nut insert molded with plastic;

FIG. 16 a view corresponding to FIG. 15 with an alternative cover nut;

FIG. 17 the view according to line XVII-XVII on FIG. 16;

FIG. 18 a side view against the connection part according to FIG. 16;

FIG. 19 a top view of a connection part in another embodiment;

FIG. 20 the section according to line XX-XX on FIG. 19;

FIG. 21 another sectional view according to FIG. 15, relating to a sealed connection position;

FIG. 22 the magnified area XXII on FIG. 12, relating to an alternative embodiment;

FIG. 23 the magnified area XXIII on FIG. 12, relating to another embodiment;

FIG. 23*a* a depiction corresponding to FIG. 23, relating to another embodiment;

FIG. 24 a longitudinal sectional view through a connection area, relating to another embodiment;

FIG. 25 a depiction corresponding to FIG. 24, relating to another embodiment;

FIG. 26 a section through a connection area in another embodiment, relating to an electrical flat plug enveloped by a casing with seals;

FIG. 27 a sectional view corresponding to FIG. 26, relating to another embodiment;

FIG. 28 a perspective view of a casing as a foldable casing;

FIG. 29 a cross section through a casing, relating to an alternative configuration.

Initially depicted and described with reference to FIG. 1 is a first electrical conductor 1, which essentially consists of a cable 4 and a cable lug 5.

The cable 4 exhibits a jacket 2 for electrically conductive wires 3. The cross section of the cable 4 is preferably circular.

The free end of the cable 4 laid bare of the jacket 2 is connected with the cable lug 5. To this end, the wires 3 extend into a tubular crimping section 6 of the cable lug 5. In this section, compression is provided to generate electrical conductivity and fix the cable lug 5 in place. The corresponding pressing area 7 may here be gleaned from the sectional view on FIG. 10.

Facing away from the cable 4, the cable lug 5 is molded into a flat push-through area 8. The latter exhibits an at least approximately square layout. As the result of deformation, the push-through area 8 is molded from the original tubular shape to yield the cable lug 5.

The push-through area 8 extends in a plane, which runs offset to a parallel plane that centrally penetrates the cable 4 and crimping section 6. In this way, an ascending stepped section 9 inclined at an angle of about 45° can be obtained between the push-through area 8 and crimping section 6.

The angle here relates to a perpendicular to the push-through area 8.

The push-through area 8 is further provided with a push-through opening 10 that preferably has a circular layout. The latter passes through the push-through area 8 in the area of its broadside surfaces with a diameter d, which corresponds to roughly half a largest dimension a of the push-through area 8.

The first conductor 1 can be allocated to a second electrical conductor 11. The conducting connection is obtained by way of an electrically conductive mandrel 12, for example a screw, as depicted, wherein the mandrel 12 engages through the push-through opening 10 of the first conductor 1.

A plastic sealing internal sheath 13 can be allocated to the first conductor 1, in particular in order to seal the free end of the first conductor 1 away from moisture penetrating in from outside in the use position.

The sealing internal sheath 13 is designed to be slipped over the free end of the first conductor 1 exhibiting the cable lug 5, and to this end preferably consists of an elastically resilient material, in particular plastic material.

The sealing internal sheath 13 is initially and essentially configured like a hose, with a tubular cylinder section 22 whose end transitions from the first embodiment depicted on FIGS. 2 to 12 into a tapered section 14, and an essentially flat receiving area 15.

The design of the sealing internal sheath 13 is further essentially adjusted to the outer contour of the cable lug 5. To this end, the receiving area 15 preferably exhibits an at least approximately square layout, adjusted to the push-through area 8 of the cable lug 5. A stepped transition (step section 16) is also provided, which connects the receiving area 15 with the cylinder section 22. The receiving area 15 extends in a plane running offset to a parallel plane that centrally penetrates the cylinder section 22.

The receiving area 15 is configured in such a way that, in the connected state, i.e., when slipped onto the cable lug 5, it almost completely envelops the push-through area 8, this in particular as relates to the free peripheral edges along with the surface areas of the broadside surfaces that envelop the push-through opening 10. The step section 9 on the cable lug side along with its crimping section 6 are completely enveloped by the sheath-side step section 16 and the cylinder section 22.

The broadside surfaces of the receiving area 15 are broken through by passage openings 17, whose free diameter d' corresponds to roughly twice the diameter d of the push-through opening 10.

In the connected state, the passage openings 17 of the receiving area 15 are preferably aligned at least approximately concentrically to the push-through opening 10 of the cable lug 5.

The passage opening 17 is enveloped on each broadside surface by a continuous sealing lip 18. The sealing lip 18 here preferably passes radially inward directly into the passage opening 17.

Each sealing lip 18 can exhibit a free height h of roughly 1.5 to 2 mm, proceeding from the facing surface of the receiving area 15 and viewed in the push-through direction r. The thickness c of each such sealing lip 18 as viewed in the radial direction can measure about 2 to 3 mm.

In addition, the sealing lip can transition into a planar area as relates to a cross section (e.g., depicted on FIG. 10). This planar area can be the adjoining connection area, which extends without elevations and/or depressions over at least a length corresponding to at least 5 or 10 times the sealing lip thickness c.

The tapering section 14 tapers conically toward its free end, and forms an opening 19 at the end. In the connected state, the cable 4 passes through the latter.

The opening 19 exhibits a selected diameter measure b that is smaller than the largest dimension a in the push-through area 8 of the cable lug 5.

In addition, the opening 19 is adjusted or adjustable to the outer diameter of the cable jacket 2. By shortening the tapering section 14 along a longitudinal extension axis x of the cylinder section 22, the opening 19 can be expanded in its diameter, and thus is adjustable to the jacket diameter.

The sealing internal sheath 13 exhibits a length e as viewed in the extension direction of the axis x that can correspond to roughly 8 to 10 times the diameter d of the push-through opening 10.

In order to bring it into the connected state with the first conductor 1, the opening 19 of the sealing internal sheath 13 is slipped over the cable lug 15, correspondingly expanding against the elastic restoring force of the tapering section 14, until it reaches a position in which the cable lug-side push-through area 8 preferably comes to abut in the receiving area 15 of the sealing internal sheath 13. The sheath-side cylinder section 22 here envelops the crimping section 6, and leaving a radial distance to the crimping section (compare FIG. 10).

The free end of the tapering section 14 continuously abuts the surface of the cable jacket 2 like a lip so as to form a seal.

The push-through area 8 of the first conductor 1 is exposed for purposes of establishing an electrical connection with the second conductor 11 in the passage opening 17 of the receiving area 15.

The first conductor 1 provided with the sealing internal sheath 13 is allocated to the second conductor 11 in such a way that the mandrel 12, for example in the form of a threaded mandrel of a screw, if necessary interspersing a washer 20 or the like, is guided through the passage openings 17 and the push-through opening 10 of the cable lug 5 in the push-through direction r, here possibly passing through an additional opening 21 in the second conductor 11 or establishing a screw connection therewith.

The sealing lips 18 hereafter annularly and tightly abut against the facing surfaces of the second conductor 11 and the first conductor 1, if necessary against a screw head or against the washer 20. Internally, i.e., facing away from the sealing lips 18, the receiving area 15 of the sealing internal sheath 13 encompassing the push-through area 8 is braced against the facing surface of the push-through area 8.

As shown on FIG. 22, another sealing lip 49 can be formed, if necessary coaxially to the sealing lip 18 and outwardly enveloping the latter. In a preferred embodiment, this sealing lip 49 is also formed out of a single piece with the sealing internal sheath 13, and out of the same material.

The sealing lip 49 can be designed to extend beyond the contact plane of the sealing lip 18, or alternatively end flush with the contact plane or be recessed relative to this plane.

In addition, the provided sealing lip 49 can be only allocated to an opening surface of the push-through opening 10, as depicted. In this regard, an arrangement on both sides is also possible.

In this way, the electrical connection area between the first conductor 1 and second conductor 11 is outwardly sealed. The electrical connection area is thereby completely covered and sealed.

The plastic sealing internal sheath 13 is reusable after the electrical connection has been disengaged and reestablished.

In the connected state, the longitudinal extension axis x of the sealing internal sheath 13 preferably extends so as to incorporate the longitudinal axis of the cable 4. Extending centrally between the sealing lips 18 in the push-through direction r, the plane of the receiving area 15 and of the push-through area 8 of the cable lug 5 runs spaced apart in the push-through direction r from a parallel plane that passes through the longitudinal extension axis x.

The longitudinal extension axis x can also be elongated so as to run through the receiving area 15, if necessary passing through the central plane described above (see FIG. 12).

In a further embodiment as depicted on FIG. 23, the transition between the tapering section 14 of the sealing internal sheath 13 and the jacket 2 (terminating) can be sealed by additional means. For example, a shrinking tube 50 can be provided, which through exposure to heat comes to circumferentially abut against the tapering section 14 and adjoining section of the jacket 2 so as to form a terminating seal. Such a shrinking tube 50 consists of polyethylene or polypropylene, for example.

Alternatively or additionally thereto, the sleeve space 51 arising between the sealing internal sheath 13 and jacket 2 can be filled with an injectable compound at least in the contact surface between the tapering section 14 and jacket 2, for example with a fat or with an adhesive, e.g., a hot-melt adhesive or 2-component adhesive.

According to the depiction on FIG. 23*a*, the end section of the sealing internal sheath 13 that faces away from the connection area and encompasses the jacket 2 of the first conductor 1 can also be straight in design, at least approximately coaxially to the jacket 2. If necessary, the seal in this area can be provided solely by a shrinking tube 50 that encompasses the end of the sealing internal sheath 13 and the adjoining section of the jacket 2.

FIGS. 13 and 14 present an embodiment showing a connection part 23 for establishing an electrical connection between two electrical conductors 1 and 11.

The connection part 23 exhibits a metal electrical conductor element 24, which is electrically connected with a connection section 25 of the first conductor 1, for example through soldering.

The conductor element 24 further exhibits an opening 26 in a terminal area A. The latter penetrates through the conductor element 24 transversely to its surface extension.

The conductor element 24 is electrically connected with the connection section 25 in a first area 27. Proceeding from the connection section 25 in relation to a vertical section according to FIG. 14, this first area 27 extends essentially perpendicular to the push-through direction r of a connection means 28 to be guided through the opening 26, e.g., a screw or bolt. In the connection area A, the conductor element 24 transitions into a second area 29, which in terms of the push-through direction r is formed on a second height level relative to the first area 27. The second area 29 is thus lowered in the push-through direction r relative to the first area 27, thereby resulting in a rotationally symmetrical, pot-shaped lowering 30 overall in the terminal area A. The height level difference as viewed in the push-through direction r between the first area 27 and second area 29 corresponds to about 2 to 3 times the material thickness of the conductor element 24.

The inner diameter of the lowering 30 corresponds to about 1.5 to 2.5 times the diameter of the bore-like opening 26.

For example, the lowering 30 can be fabricated by deep drawing the respective conductor element area. In order to realize the lowering 30, a plane-offset section can alternatively be welded or adhesively bonded to the correspondingly released area of the conductor element 24, and further alternatively be screwed to the conductor element.

The connection part 23 is enveloped by an elastically resilient plastic. The resultant plastic sheathing 31 is preferably achieved by insert molding the conductor element 24, including the connection section 25 of the first conductor 1. The plastic sheathing 31 is designed so as to also encompass the jacket 2 of the first conductor 1 on the end side, along with the connection section 25 adjoining the latter.

In relation to its flat sides, the conductor element 24 is covered by the plastic sheathing 31 from above and below, as well as on the sides, except for areas in the terminal area A.

In this terminal area, the lower surface of the pot floor facing a second conductor 11 is not covered by plastic so as to electrically contact the second conductor, as further preferably the case for the upper surface of the pot floor 32 facing away from the second conductor 11, along with the continuous inner surface of the pot wall 33.

A sealing lip 34, 35 molded out of the plastic sheathing 31 is formed running concentrically to the opening 26 both on the pot opening side of the lowering 30, and on the opposing surface. The latter is realized in the form of a continuous sealing bead that protrudes over the enveloping surface of the plastic sheathing 31 in or opposite the push-through direction r.

According to the depictions on FIGS. 13 and 14, the sealing lip 34 provided on the pot opening side can serve to interact with a surface of a connection means 28 inserted through the opening. The depiction provides a hexagon bolt, which abuts tightly against the sealing lip 34 with a flat side of the screw head aligned transverse to the push-through direction r. The threaded section of the connection means 28 penetrates through the opening 26, while a collar section 36 with a larger diameter relative to the threaded section preferably dips into the lowering area of the conductor element 24 so as to fill space. The collar section 36 can here be conductively connected with the pot floor 32 and inside of the interior pot wall 33.

In a connection position, the additional sealing lip exerts a sealing effect against the facing surface of the second conductor 11, thereby protecting the terminal area A against moisture penetrating from outside.

FIGS. 15 to 21 show further embodiments and exemplary applications based on a connection part 23 according to the exemplary embodiment on FIGS. 13 and 14.

According to the depiction on FIG. 15, for example, a bolt 37 can pass through the opening 26, which is bolted to the pot opening side of the lowering with a cover nut 38. The cover nut 38 is preferably a metal cap nut.

In the area of its wrench surfaces and cap section, the cover nut 38 is covered by a plastic 39, in particular a hard plastic. As a result, the cover nut 38 is almost completely covered by plastic 39, except for the contact surface 40 of the cover nut 38 facing the opening 26. The front surface of the enveloping plastic 39 pointing in the placement direction, i.e., in the push-through direction r, preferably extends on a shared plane with the contact surface 40.

On the outside of the wall, the plastic 39 forms wrench surfaces 31 in relation to an instantaneous axis that radially overlap the wrench surfaces of the cover nut 38, for example to actuate the plastic-covered cover nut 38 with a wrench or the like.

With its contact surface 40, or optionally with the continuous, in-plane front surface of the plastic 39, the cover nut 38 abuts against the sealing lip 34 of the connection part 23 facing the latter so as to form a seal.

As illustrated, an annular insert 32 can be placed in the lowering 30 of the conductor element 24, while resting on the pot floor 32 and loaded by the cover nut 38 in the push-through direction r.

FIGS. 16 to 17 show an embodiment in which the metal cover nut 38 receives the bolts 37 and extends up to the base of the pot floor 32. In this embodiment, an abutment against the sealing lip 34 is achieved solely via the abutment of the plastic 39 enveloping the cover nut 38.

In this embodiment as well, the plastic 39 is provided with wrench surfaces 41 on the outer walls. The cured plastic 39 is joined with the cover nut 38 secured against rotation by insert molding the wrench surfaces on the nut side. A withdrawal safeguard can be achieved by having a radially inwardly protruding plastic rib engage into a continuous annular groove 43 of the cover nut 38 (see FIG. 16).

Facing the pot opening of the lowering 30 and circumferentially to the latter, a freestanding, continuous collar 44 can be formed as a single piece and integrally with the plastic sheathing 31. Its free inner diameter preferably corresponds to that of the pot-shaped lowering 30.

In the area of the free end, the collar 44 is provided with a radially outwardly facing continuous latching lip 45.

The collar 44 with this latching lip 45 is used to fix a sealing cap 46 in place. A bendable, strip-like extension 47 secures the latter to the plastic sheathing 31, wherein the extension 47 extends on the area of the terminal area A lying opposite the connection section 25 according to the depiction on FIG. 20. The plastic sheathing 31, extension and sealing cap 46 can be designed as an integral, single piece, as is also preferred.

The lowering can have placed into it a screw head of a connection means 38, e.g., a screw, the threaded section of which passes through the opening 26. The screw head is optionally supported directly on the pot floor 32, and is entirely incorporated in the lowering 30.

By swiveling the sealing cap 46 over the extension 47, the sealing cap 46 can be moved into a position that covers the opening of the lowering 30, in which the sealing cap 46 can be latched by means of the latching lip 45. This covers the area of the lowering 30 in terminal area A so as to form a seal.

The second conductor 11 is penetrated by the threaded section of the screw, and presses against the sealing lip 35 of the connection part 23 so as to form a seal.

The screwed fixation of the second conductor 11 on the first conductor 1 or on the conductor element 24 of the connection part 3 is brought about with a cover nut 38. The cover nut 38 is essentially encased by plastic 39 according to the embodiments on FIGS. 15 to 18. The plastic 39 exhibits wrench surfaces 41 here as well.

Provided in the area of the contact surface 40 of the cover nut 38 or plastic 39 is a sealing bead 48. Preferably involved here is a sealing bead 48 made out of an elastically resilient material, such as rubber.

In relation to a cross section according to FIG. 20, the sealing bead 38 is partially covered by the plastic 39 that further envelops the cover nut 38, and a partial area thereof here freely extends beyond the contact surface 40 in the unloaded position.

In the connection position shown, the terminal area A is outwardly sealed against moisture by means of the sealing bead 48 on the one hand and the sealing lip 35 of the connection part 23 acting against the second conductor on the other, and furthermore after the lowering 30 has been covered by the sealing cap 46.

FIG. 21 shows a sealed connection between two conductors 1 and 11 that uses a prescribed connection part 23 and a plastic-sheathed cover nut 38 according to the embodiment on FIG. 15, wherein the second conductor 11 is braced against the conductor element 24 of the first conductor 1 by a cover nut 38 according to the embodiment on FIG. 20.

Three sealing planes are provided in this connection position, firstly by the sealing lip 34 acting with the contact surface 40 of the one cover nut 38, and further by the sealing lip 35 that interacts with the second conductor 11, and by the sealing bead 48 of the additional cover nut that also interacts with the second conductor. Furthermore, both cover nuts 38 are sheathed by plastic 39.

According to the depictions on FIGS. 24 and 25, sealing lips 52 acting in a radial direction can be provided on the top and bottom sides, if necessary in addition to the sealing lips 18 acting in an axial direction, for example to interact with a conically tapering pole 53 of a battery so as to form a seal, with the pole 53 comprising the second conductor 11.

One side of the sealing internal sheath 13 can also be axially provided with a cover 54, for example one that overlays the pole 53.

FIGS. 26 and 27 each show a plug assembly comprised of a flat plug 55 that forms the second conductor 11 and a blade receptacle 56 that forms the first conductor 1. As depicted on FIG. 26, the blade receptacle 56 can be provided with a sealing sleeve 57 that envelops the latter.

A casing 58 can be provided in particular to protect such a plug connection in particular against penetrating moisture. The latter envelops the plug-in area.

The casing 58 is provided with at least one sealing lip 59. In the exemplary embodiments shown, two sealing lips 59 are provided, of which one forms a seal directly against the first conductor 1 according to the depiction on FIG. 27, or against the sealing sleeve 57 of the first conductor 1 according to the depiction on FIG. 26. For example, the additional sealing lip 59 forms a seal against a socket 60 that carries the flat plug 55.

With regard to the extension direction of the plug connection, the sealing lips 49 essentially act radially inwardly.

Additionally or alternatively, in particular with respect to the radially acting sealing lip 59 in the area of the socket 60, an axially acting sealing lip 61 can also be provided (see dash-dot depiction on FIG. 27).

The casing 58 can be present as a foldable or pluggable casing. FIGS. 28 and 29 show a respective foldable casing.

Two casing halves 62 and 63 are present, which are hinged together by means of a hinge 64. Given a preferred single-piece configuration of the casing 58, the hinge 64 is designed as a film hinge, for example.

The walls of the casing 58 aligned transverse to the separating plane each incorporate through holes 65, in the area of which the sealing lip 59 is positioned.

The sealing lip 59 can be molded onto the casing 58, for example while manufacturing the casing 58 in a two-component injection molding process (see FIGS. 26 and 27).

Alternatively, the sealing lip 59 can also be allocated to the casing 58 as a loose part, for example in the form of an O-ring (see FIG. 28).

With regard to a cross section according to FIG. 29, the sealing lip 59 can also be an essentially open O-ring seal, which in the closed position of the casing 58 is enhanced into a continuously closed seal. For example, such a sealing lip 59 can exhibit overlapping sections 66 in the area of free ends that face each other.

The casing 58 provided with the splashed sealing lip 59 or with an inlaid sealing lip 59 open in the circumferential direction is guided around the electrical plug connection, and finally brought into a closed position by folding the casing halves 62 and 63 around the hinge 64, with the sealing lips 59 abutting against the first conductor 1 and/or second conductor 11 so as to form a seal in this closed position.

The closed casing position is preferably secured, for example secured by a latch. To this end, the outside of the casing can be provided with a latching hook 67, which in the closed position establishes a lock by engaging behind a catch mechanism 68 of the other casing half.

The exemplary embodiments described above for sealing an electrical connection can also exhibit such a casing, in particular a foldable or pluggable casing.

The above statements serve to explain the inventions encompassed by the application in their totality, which further develop prior art at least with the following features, whether taken in combination or separately, specifically:

A plastic sealing internal sheath, characterized in that, on its end allocated to the push-through area 8 of the first conductor 1, the sealing internal sheath 13 that can be slipped over the first conductor 1 exhibits a receiving area 15 for the first conductor 1 that is completely enclosed transverse to a push-through direction r, and a passage opening 17 in the push-through direction r, wherein the passage opening 17 in the push-through direction r exhibits a first and a second opening edge, and has a closed, continuous sealing lip 18 at least on the second opening edge, and that the end of the sealing internal sheath 13 facing away from the connection area is designed to interact with the first conductor 1 so as to form a seal.

A plastic sealing internal sheath, characterized in that the passage opening 17 has sealing lips at both opening edges.

A plastic sealing internal sheath, characterized in that the end of the sealing internal sheath 13 facing away from the connection area exhibits a tapering section 14 for interacting with the first conductor 1 so as to form a seal.

A plastic sealing internal sheath, characterized in that a shrinking tube 50 is provided for purposes of sealing interaction, and encompasses the end of the sealing internal sheath 13 facing away from the connection area and the first conductor 1.

A plastic sealing internal sheath, characterized in that a contour of the area adjoining the sealing lips 18 protrudes over at least the central area of the upper and/or lower sealing lip in a longitudinal direction of the sealing internal sheath 13 or of the first conductor 1 with the sealing internal sheath 13 slipped on.

A plastic sealing internal sheath, characterized in that, with the sealing internal sheath 13 not slipped on, the tapering section 14 exhibits an opening 19 with a diameter measure b that is smaller in every direction than a largest dimension a of the first conductor 1 in the push-through area 8.

A plastic sealing internal sheath, characterized in that the sealing internal sheath 13 exhibits a length e corresponding to two or more times the free diameter d of a push-through opening 10 of the first conductor 1.

A plastic sealing internal sheath, characterized in that the sealing internal sheath 13 exhibits the outer contour of a cable lug 5 at least as allocated to the receiving area 15.

A plastic sealing internal sheath, characterized in that, in the connected state, the sealing internal sheath 13 envelops the first conductor 1 partially at a distance transverse to its longitudinal extension.

A plastic sealing internal sheath, characterized in that the first conductor 1 exhibits a sheathing 2, and that, in the connected state, the tapering section 14 of the sealing internal sheath 13 interacts with an outer surface of the sheathing 2 so as to form a seal.

A plastic sealing internal sheath, characterized in that the sealing lip 18 exhibits a free height h of 0.5 to 3 mm, and a thickness c transverse to the push-through direction of 0.5 to 3 mm.

A plastic sealing internal sheath, characterized in that a cross section of the sealing lip 18 transitions into a planar area that extends at least over the sealing lip 18 by the measure of thickness c of the sealing lip 18 up to 10 times or more than the thickness c of the sealing lip 18 without any elevations and/or depressions.

A connection part, characterized in that, in a cross section where the push-through direction r resembles a line, the conductor element 24 exhibits a first area 27 on a first height level and a second area 29 on a second height level, wherein the first area 27 is farther away from the opening 26 than the second area 29, the first area comes before the second area 29 in the push-through direction r, and the sealing lip 34, 35 is designed to envelop the second area 29, wherein another connection section 25 formed on one or more additional height levels can adjoin the area 27 on the first height level further away from the opening 26, and that the sealing lip 34, 35 in the non-deformed state protrudes over the second area of the conductor element 24 that is otherwise exposed on the sealing lip side in the push-through direction r, but can through deformation be forced back until into a plane that forms the lower side of the second area.

A connection part, characterized in that the connection part 23 exhibits two continuous sealing lips 34, 35 in a cross sectional view, which are situated opposite to each other relative to the push-through direction 4.

A connection part, characterized in that the transition between the first and second height level has a stepped design in cross section.

A connection part, characterized in that the enveloping plastic continues in an exposed collar 44 opposite the lowering 30 provided by the conductor element 24 on the second height level.

A connection part, characterized in that the collar 44 exhibits a continuous latching lip 45 for establishing a latched connection with a cap 45.

A connection part, characterized in that the cap 46 is designed as a single piece with the plastic sheathing 31 by way of a bendable extension 47.

A connection part, characterized in that the plastic sheathing 31 is obtained by insert molding the conductor element 24.

A connection part, characterized in that the conductor element 24 is part of a cable lug.

A connection part, characterized in that the sealing lip is part of a foldable or pluggable casing 48 that can be placed on the conductor element.

A casing, characterized in that the casing 58 is designed as a foldable or pluggable casing, and exhibits a molded-on or inlaid sealing lip 59, such that the sealing lip 59 protrudes over an area of the casing 58 without a sealing lip with the casing 58 placed on a conductor 1, 11.

A casing, characterized in that, if configured as a foldable casing, the casing 58 is designed as a single part, if necessary except for the sealing lip 59.

A casing, characterized in that the casing 58 consists of a hard plastic, and the sealing lip 59 consists of a soft plastic.

A cover nut 38 for an electrical conductor connection, wherein the cover nut 38 is closed in cross section opposite a screw-in opening, and forms a lower contact surface 4 that runs perpendicular to a placement direction, which is characterized in that the cover nut 38 is completely enveloped by plastic 39, but only up to a plane of the contact surface 40 relative to a cross section in the area of the screw-in opening.

A cover nut, characterized in that the plastic 39 is a hard plastic.

A cover nut, characterized in that the plastic 39 forms wrench surfaces 41 for actuating the cover nut 38 by means of a wrench.

A cover nut, characterized in that the cover nut 38 exhibits a sealing bead 48 that protrudes over the contact surface 40 in the insertion direction in a cross section relative to the contact surface 40.

A cover nut, characterized in that the sealing bead 48 consists of rubber or an elastically resilient plastic.

A cover nut, characterized in that the sealing bead 48 is partially covered in cross section by the plastic 39 that otherwise envelops the cover nut 38.

A connection, characterized in that the plastic jacket of the cover nut 38 or screw head is sealed away from the conductor element 24 by a sealing lip 34, 35 consisting of plastic or rubber, and that the side of the connection part 23 of the electrical conductor element 24 facing away from the cover nut 38 or screw head exhibits a sealing lip 35 that interacts with the second conductor 11.

A connection, characterized in that the additional cover nut 38 is enveloped by plastic 39, and exhibits a sealing bead 48 consisting of plastic or rubber, which seals the additional cover nut 38 away from the second conductor 11, and that the side of the connection part 23 of the electrical conductor element 24 that faces away from the facing cover nut 38 or the facing screw head exhibits a sealing lip 35 that interacts with the second conductor 11.

All disclosed features are essential to the invention (either taken in isolation or combined with each other). The disclosure of the application hereby also includes the disclosure content of the accompanying/attached priority documents (copy of advance notification) in its entirety, further with the purpose of also incorporating features of these documents into the claims of the present application. The features in the subclaims characterize independent inventive further developments of prior art, in particular so as to introduce partial applications based upon these claims.

REFERENCE LIST

1 First conductor
2 Jacket
3 Wire
4 Cable
5 Cable lug
6 Crimping section
7 Pressing area
8 Push-through area
9 Step section
10 Push-through opening
11 Second conductor
12 Mandrel
13 Plastic sealing internal sheath

14 Tapering section
15 Receiving area
16 Step section
17 Passage opening
18 Sealing lip
19 Opening
20 Washer
21 Opening
22 Cylinder section
23 Connection part
24 Conductor element
25 Connection section
26 Opening
27 First area
28 Connection means
29 Second area
30 Lowering
31 Plastic sheathing
32 Pot floor
33 Pot wall
34 Sealing lip
35 Sealing lip
36 Collar section
37 Bolt
38 Cover nut
39 Plastic
40 Contact surface
41 Wrench surface
42 Insert
43 Annular groove
44 Collar
45 Latching lip
46 Cap
47 Extension
48 Sealing bead
49 Sealing lip
50 Shrinking tube
51 Sleeve space
52 Sealing lip
53 Pole
54 Cover
55 Flat plug
56 Blade receptacle
57 Sealing sleeve
58 Casing
59 Sealing lip
60 Socket
61 Sealing lip
62 Casing half
63 Casing half
64 Hinge
65 Through hole
66 Overlapping section
67 Latching hook
68 Catch mechanism
a Dimension
b Diameter
c Thickness
d Diameter
d' Diameter
e Length
h Height
r Push-through direction
x Longitudinal extension axis
A Terminal area

The invention claimed is:

1. A plastic sealing internal sheath (13) for an electrical connection between a first conductor (1) and a second conductor (11), wherein, in the connected state, the first conductor (1) is joined with the second conductor (11) by means of a mandrel (12) that yields a conductive connection, wherein the mandrel (12) passes through a push-through area (8) of the first conductor (1), wherein the sealing internal sheath (13) that can be slipped over the first conductor (1) exhibits a receiving area (15) for the first conductor (1) completely enveloped transverse to a push-through direction (r) at its end allocated to the push-through area (8) of the first conductor (1), and a passage opening (17) in the push-through direction (r), wherein the passage opening (17) exhibits a first and second opening edge in the push-through direction (r), and has a closed, continuous sealing lip (18) at least on the second opening edge, the sealing lip protruding outward from the push-through area, and the end of the sealing internal sheath (13) facing away from the connection area is designed to interact with the first conductor (1) so as to form a seal, and wherein the sealing lip (18) transitions into an area that is planar in cross-section, the planar area extending away from the sealing lip in a radial and/or longitudinal direction of the sealing internal sheath and extending outside of the sealing internal sheath wall, facing away from the first conductor.

2. The plastic sealing internal sheath according to claim 1, wherein the sealing internal sheath (13) facing away from the connection area exhibits a tapering section (14) for interacting with the first conductor (1) so as to form a seal.

3. The plastic sealing internal sheath according to claim 1, wherein, with the sealing internal sheath (13) not slipped on, the tapering section (14) exhibits an opening (19) with a diameter measure (b) that is smaller in every direction than a largest dimension a of the first conductor (1) in the push-through area (8).

4. The plastic sealing internal sheath according to claim 1, wherein the first conductor (1) exhibits a sheathing (2), and wherein, in the connected state, the tapering section (14) of the sealing internal sheath (13) interacts with an outer surface of the sheathing (2) so as to form a seal.

5. The plastic sealing internal sheath according to claim 1, wherein the passage opening (17) has sealing lips (18) at both opening edges.

6. The plastic sealing internal sheath according to claim 5, wherein a contour of the area adjoining the sealing lips (18) protrudes over at least the central area of the upper and/or lower sealing lip in a longitudinal direction of the sealing internal sheath (13) or of the first conductor (1) with the sealing internal sheath (13) slipped on.

7. A connection part (23) for establishing an electrical connection between two electrical conductors (1, 11), with a metal electrical conductor element (24), which is enveloped at least on one terminal area (A) by an elastically resilient plastic and forms a sealing lip (34, 35) that envelops the terminal area (A), and protrudes outward from terminal area A, wherein the terminal area (A) exhibits an opening (26) that can be penetrated by a connection means (28), such as a screw or bolt, in a push-through direction (r), wherein, in a cross section where the push-through direction (r) resembles a line, the conductor element (24) exhibits a first area (27) on a first height level and a second area (29) on a second height level, wherein the first area (27) is farther away from the opening (26) than the second area (29), the first area (27) comes before the second area (29) in the push-through direction (r), and the sealing lip (34, 35) is designed to envelop the second area (29), wherein another connection section (25) formed on one or more additional height levels can adjoin the area (27) on the first height level further away from the opening (26), and wherein the sealing lip (34, 35) in the non-deformed state protrudes over the second area of the conductor element (24) that is otherwise exposed on the sealing lip side in the push-through direction (r), but can through deformation be forced back until into a plane that forms the lower side of the second area, and wherein the sealing lip (34, 35) transitions into an area that is planar in cross-section, the planar area extending away from the sealing lip in a radial and/or longitudinal direction of the sealing internal sheath and extending outside of the sealing internal sheath wall, facing away from the first conductor.

8. The connection part according to claim 7, wherein the connection part (23) exhibits two continuous sealing lips (34, 35) which are situated opposite to each other in a cross sectional view relative to the push-through direction.

9. The connection part according to claim 7, wherein the transition between the first and second height level has a stepped design in cross section.

10. The connection part according to claim 7, wherein the conductor element (24) is part of a cable lug.

11. The connection part according to claim 7, wherein the sealing lip is part of a foldable or pluggable casing (48) that can be placed on the conductor element.

12. The connection part according to claim 7, wherein the elastically resilient plastic continues in an exposed collar (44) opposite a lowering (30) provided by the conductor element (24) on the second height level.

13. The connection part according to claim 12, wherein the collar (44) exhibits a continuous latching lip (45) for establishing a latched connection with a cap (45).

14. The connection part according to claim 13, wherein the cap (46) is designed as a single piece with the plastic sheathing (31) by way of a bendable extension (47).

15. A connection part (23) for establishing an electrical connection between two electrical conductors (1, 11), with a metal electrical conductor element (24), which is enveloped at least on one terminal area (A) by an elastically resilient plastic and forms a sealing lip (34, 35) that envelops the terminal area (A), wherein the terminal area (A) exhibits an opening (26) that can be penetrated by a connection means (28), such as a screw or bolt, in a push-through direction (r), wherein, in a cross section where the push-through direction (r) resembles a line, the conductor element (24) exhibits a first area (27) on a first height level and a second area (29) on a second height level, wherein the first area (27) is farther away from the opening (26) than the second area (29), the first area (27) comes before the second area (29) in the push-through direction (r), and the sealing lip (34, 35) is designed to envelop the second area (29), wherein another connection section (25) formed on one or more additional height levels can adjoin the area (27) on the first height level further away from the opening (26), and wherein the sealing lip (34, 35) in the non-deformed state protrudes over the second area of the conductor element (24) that is otherwise exposed on the sealing lip side in the push-through direction (r), but can through deformation be forced back until into a plane that forms the lower side of the second area, wherein a cover nut (38) is provided for an electrical conductor connection, wherein the cover nut (38) is closed in cross section opposite a screw-in opening, and forms a lower contact surface (4) that runs perpendicular to a placement direction, wherein the cover nut (38) is further completely enveloped by plastic (39), but only up to a plane of the contact surface (40) relative to a cross section in the area of the screw-in opening.

16. The connection part according to claim 15, wherein a sealed connection is established between two electrical conductors (1, 11), wherein the one electrical conductor (1) exhibits a connection part (23) with a metal electrical conductor element (24), which is enveloped at least on one terminal area (A) by an elastically resilient plastic, wherein the terminal area (A) exhibits an opening (26) that is penetrated by a screw or bolt in a push-through direction (r), wherein a plastic-sheathed cover nut (38) is further screwed onto the bolt, or the screw exhibits a plastic-sheathed screw head, and the second conductor (11) is penetrated by the screw (28) or bolt, wherein the screw (28) or bolt is provided on the side of the conductor lying opposite the conductor element (24) with a cover nut (38) for mounting the second conductor (11) to the conductor element (24), wherein the additional cover nut (38) is further enveloped by plastic (39), and exhibits a sealing bead (48) made out of plastic or rubber, which seals the additional cover nut (38) away from the second conductor (11), and wherein the side of the connection part (23) of the electrical conductor element (24) facing away from the facing cover nut (38) or the facing screw head exhibits a sealing lip (35) that interacts with the second conductor (11).

17. A connection part (23) for establishing an electrical connection between two electrical conductors (1, 11), with a metal electrical conductor element (24), which is enveloped at least on one terminal area (A) by an elastically resilient plastic and forms a sealing lip (34, 35) that envelops the terminal area (A), wherein the terminal area (A) exhibits an opening (26) that can be penetrated by a connection means (28), such as a screw or bolt, in a push-through direction (r), wherein, in a cross section where the push-through direction (r) resembles a line, the conductor element (24) exhibits a first area (27) on a first height level and a second area (29) on a second height level, wherein the first area (27) is farther away from the opening (26) than the second area (29), the first area (27) comes before the second area (29) in the push-through direction (r), and the sealing lip (34, 35) is designed to envelop the second area (29), wherein another connection section (25) formed on one or more additional height levels can adjoin the area (27) on the first height level further away from the opening (26), and wherein the sealing lip (34, 35) in the non-deformed state protrudes over the second area of the conductor element (24) that is otherwise exposed on the sealing lip side in the push-through direction (r), but can through deformation be forced back until into a plane that forms the lower side of the second area, wherein a plastic-sheathed cover nut (38) is further screwed onto the bolt, or the screw exhibits a plastic-sheathed screw head, wherein the plastic sheathing of the cover nut (38) or screw head is further sealed away from the conductor element (24) by a sealing lip (34, 35) comprising plastic or rubber, and wherein the side of the connection part (23) of the conductor element (24) facing away from the cover nut (38) or screw head exhibits a sealing lip (35) that interacts with the second conductor (11).

* * * * *